US005667193A

United States Patent [19]

Chrzanowski

[11] Patent Number: 5,667,193

[45] Date of Patent: Sep. 16, 1997

[54] SAFETY SHUT-OFF DEVICE FOR GAS WELDING APPARATUS

[76] Inventor: Edward R. Chrzanowski, 36 B Gibbs St., Apt. 18, Worcester, Mass. 01607

[21] Appl. No.: 497,364

[22] Filed: Jun. 30, 1995

Related U.S. Application Data

[63] Continuation-in-part of Ser. No. 294,932, Aug. 23, 1994, abandoned.

[51] Int. Cl.[6] ..... F16K 35/00

[52] U.S. Cl. ..... 251/104; 251/110; 251/243; 251/224; 251/78; 266/48

[58] Field of Search ..... 251/99, 95, 113, 251/111, 243, 242, 240, 246, 245, 244, 78, 104, 110; 266/48

[56] References Cited

U.S. PATENT DOCUMENTS

| | | | |
|---|---|---|---|
| 1,162,199 | 11/1915 | Winans et al. | 251/246 |
| 1,538,194 | 5/1925 | Levedahl | 251/245 |
| 1,734,589 | 11/1929 | McIntosh | 251/246 |
| 1,757,473 | 5/1930 | Piefer | 251/240 |
| 2,026,028 | 12/1935 | Fausek et al. | 251/243 |
| 2,335,987 | 12/1943 | Young | 251/246 |
| 2,344,219 | 3/1944 | Smith | 251/243 |
| 2,371,970 | 3/1945 | Marra | 251/240 |
| 2,666,479 | 1/1954 | Clinton, Jr. | 251/243 |
| 3,228,452 | 1/1966 | Watterson | 266/48 |
| 4,093,191 | 6/1978 | Ferguson | 266/48 |
| 4,760,994 | 8/1988 | Ferguson | 266/48 |
| 4,806,096 | 2/1989 | Kobayashi | 266/48 |
| 5,069,421 | 12/1991 | Kishi | 251/113 |
| 5,479,956 | 1/1996 | Yuda | 251/95 |

FOREIGN PATENT DOCUMENTS

| | | | |
|---|---|---|---|
| 101417 | 1/1963 | Norway | 251/245 |
| 775381 | 5/1957 | United Kingdom | 251/246 |

*Primary Examiner*—Denise L. Ferensic
*Assistant Examiner*—Joanne Y. Kim
*Attorney, Agent, or Firm*—Blodgett & Blodgett, P.C.

[57] ABSTRACT

A safety shut-off device is disclosed. The device is adapted for use with a gas welding apparatus, the apparatus having a torch handle and a supply of a pressurized combustion reagent. The safety shut-off device has a valving assembly that is adapted to be positioned between the torch handle and the supply of pressurized combustion reagent. The valving assembly is actuatable between a first state and a second state. In the first state, the torch handle is operatively connected to the supply of pressurized combustion reagent. In the second state, the handle is operatively disconnected from the supply of pressurized combustion reagent. The valving assembly is biased towards the second state and actuatable from the first state to the second state substantially instantaneously. The safety shut-off device also has an actuating mechanism. At least a portion of the actuating mechanism is adapted to be positioned on the handle for being grasped by the user of the gas welding apparatus when the user grasps the handle. The portion of the actuating mechanism is also for being moved toward the torch handle. The actuating mechanism is operatively connected to the valving assembly for actuating the valving assembly from the second state to the first state only when the handle and the portion of the actuating mechanism are grasped by the user and moved towards one another.

2 Claims, 4 Drawing Sheets

SAFETY SHUT-OFF DEVICE FOR GAS WELDING APPARATUS

CROSS-REFERENCE

This application is a continuation-in-part application of the application of Edward R. Chrzanowski, Ser. No. 08/294,932, filed Aug. 23, 1994, entitled, "SAFETY DEVICE FOR GAS WELDING APPARATUS", now abandoned.

BACKGROUND OF THE INVENTION

The field of invention relates generally to safety devices, and more particularly, pertains to a safety shut-off device, or dead-man switch, for gas welding apparatus.

A well known problem in the gas welding industry is that the technology for gas welding apparatus has not been evolving as quickly as that of other industrial devices. This is especially unfortunate in light of the inherent danger in the use of cutting and welding equipment such as that which uses a combination of either oxygen and acetylene or oxygen and propane. The danger is at such a level that some service stations are denied the use of the apparatus because of insurance rules. The danger inherent in applying a flame to the grease laden under-carriage of a motor vehicle is apparent. Also, there are often combustibles, such as rags, in the vicinity of the work area. The danger even exists for the standard plumber's pony torch which operates on air and acetylene.

One attempt to improve the safety of gas welding apparatus involves the use of fire extinguishers at the work area. Relying solely on the user of the gas welding apparatus to utilize the fire extinguisher has proved impractical. For example, the user must turn off the gas welding apparatus, set down the torch handle, locate the fire extinguisher, which is often some distance from the location of the mishap, and return to the location to begin the extinguishing process. Attempts to have a second person standing by with an extinguisher have not proved practical.

Some attempts have been made to equip gas welding apparatus with complex and bulky devices for cutting off the combustion reagents and for beginning the flow of an extinguishing gas through the apparatus. However, such devices have required a positive action to accomplish the desired result.

There has been no provision for a true "deadman" switch for gas welding apparatus, or a pony torch, where a positive action is required to permit the torch to burn, and where the release of the apparatus will cause the flame to extinguish.

A further problem has been that any safety devices available for gas welding apparatus have required the purchase of new equipment with the safety device. In other words, there has been no provision for retrofitting existing gas welding apparatus with safety devices.

These and other difficulties experienced with the prior art devices have been obviated in a novel manner by the present invention.

It is, therefore, a principal object of the invention to provide a novel safety shut-off device for gas welding apparatus that will provide a true dead-man switch, whereby the positive action of grasping a trigger member is required for the apparatus to operate.

Another object of this invention is the provision of such a safety shut-off device that can be retro-fitted to existing gas welding apparatus.

A further object of the present invention is the provision of such a safety shut-off device in which the trigger actuating the apparatus is dimensioned and configured to be grasped by two hands at once, allowing the user to change hands without releasing the trigger of the safety shut-off device.

It is another object of the instant invention to provide such a safety shut-off device in which the user will not have to readjust the mixture of gasses in the gas welding apparatus to re-light the apparatus after the safety shut-off device extinguishes the flame of the apparatus.

A still further object of the invention is the provision of a such a safety shut-off device which is simple in construction, inexpensive to manufacture, and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

It has now been found that the foregoing and related objects may be readily attained in a safety shut-off device adapted for use with a gas welding apparatus, the gas welding apparatus having both a torch handle and a supply of a pressurized combustion reagent.

The safety shut-off device includes valving means adapted to be positioned between the handle and the supply of pressurized combustion reagent. The valving means is actuatable between a first state and a second state. In the first state, the torch handle is operatively connected to the supply of pressurized combustion reagent. In the second state, the handle is operatively disconnected from the supply of pressurized combustion reagent. The valving means is biased towards the second state and actuatable from the first state to the second state substantially instantaneously.

The safety shut-off device also includes actuating means. At least a portion of the actuating means is adapted to be positioned on the torch handle for being grasped by the user of the gas welding apparatus when the user grasps the handle. The portion of the actuating means is also for being moved toward the torch handle. The actuating means is operatively connected to the valving means for actuating the valving means from the second state to the first state only when the handle and the portion of the actuating means are grasped by the user and moved towards one another.

Preferably, the actuating means is comprised of trigger means and linkage means, with the trigger means being the portion of the actuating means adapted to be positioned on the handle. The linkage means operatively connects the trigger means to the valving means.

In a preferred embodiment, the trigger means includes a clamp which is adapted to circumscribe and be releasably secured to the torch handle. The trigger means further includes an elongated trigger member which has a pivotable end and a free end. The pivotable end of the trigger member is pivotably mounted on the clamp so that the trigger member overlays at least a portion of the handle and lies parallel to the longitudinal axis of the handle. This allows the trigger member to be grasped by the user of the gas welding apparatus when the user grasps the handle.

Preferably the safety shut-off device also includes a lock-out member adapted to be reciprocatably interposed between the trigger member and the handle. This serves to limit the pivoting of the trigger member about the clamp and prevent inadvertent actuation of the valving means.

Additionally, the linkage means of the safety shut-off device desirably has a linkage rod with a trigger end portion and a valve end portion. The linkage rod is pivotably attached at its trigger end portion to the trigger member, and operatively connected at its valve end portion to the valving means.

The valving means of the safety shut-off device preferably has at least one plunger valve having a valve seat and a reciprocatable plunger member passing through the valve seat for movement along a line of travel which is parallel to the longitudinal axis of the torch handle. The plunger member has an end adapted to be adjacent the handle. The linkage means further includes a pressure plate operatively connected to the valve end portion of the linkage rod, and rotatable about an axis which is at a right angle to the longitudinal axis of the handle. The pressure plate overlies the end of the plunger member, so that movement of the linkage rod, toward the valve, causes rotation of the pressure plate. The pressure plate engages the end of the plunger member, and moves the plunger member along the line of travel.

In the preferred embodiment, the safety shut-off device has a double elbow member. The double elbow member has an upper horizontal portion with a forward end adapted to be adjacent the handle and a rear end adapted to be distal from the handle. The forward end of the upper horizontal portion is adapted to be releasably attachable to the handle. The double elbow member also has a lower horizontal portion with a forward end adapted to be adjacent the handle and a rear end adapted to be distal from the handle. Additionally, the device includes a vertical portion connecting the rear end of the upper horizontal portion and the forward end of the lower horizontal portion. The plunger valve is preferably seated in the lower horizontal portion of the double elbow member.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
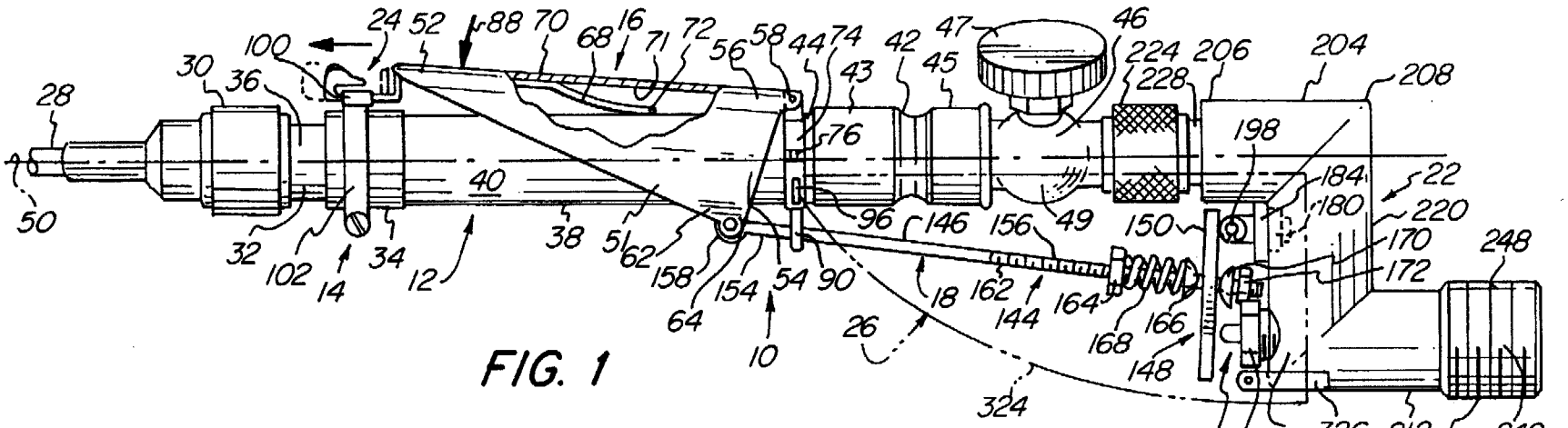
FIG. 1 is a side elevational view of a safety shut-off device, embodying the principals of the present invention, and shown mounted on a torch handle, with part of the trigger member broken away to show detail, and the welding tip shown in fragment.
Figure 2:
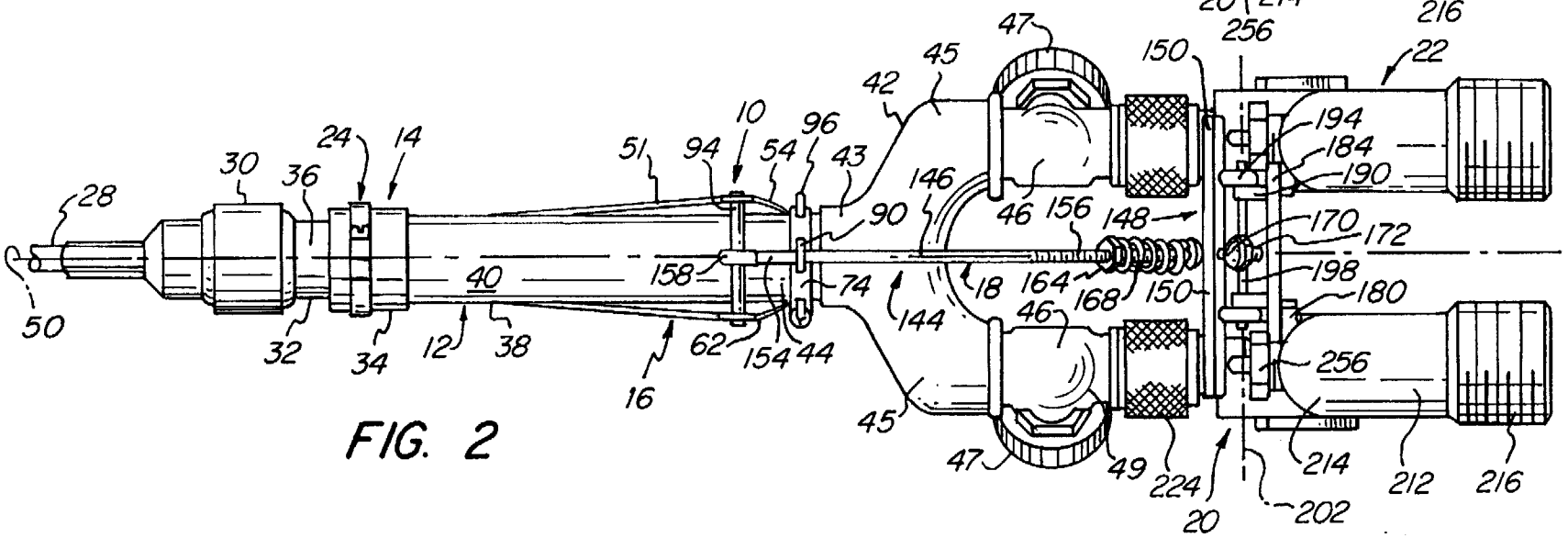
FIG. 2 is a bottom plan view of the safety shut-off device and torch handle of FIG.

With reference now to the drawings, there is shown in FIGS. 1 and 2, a safety shut-off device, embodying the principles of the present invention, and generally indicated by the reference numeral 10. The safety shut-off device 10 is shown mounted on a torch handle, generally indicated by the reference numeral 12, of a gas welding apparatus, generally indicated by the reference numeral 14.

The safety shut-off device 10 includes a trigger assembly, generally indicated by the reference numeral 16, mounted on the torch handle 12. A linkage assembly, generally indicated by the reference numeral 18, serves to operatively connect the trigger assembly 16 with a plunger valve assembly, generally indicated by the reference numeral 20, which is seated in a double elbow housing, generally indicated by the reference numeral 22.

A lock-out assembly, generally indicated by the reference numeral 24, serves to prevent inadvertent actuation of the plunger valve assembly 20. Further, a shield plate assembly, generally indicated by the reference numeral 26, helps to prevent damage to the linkage assembly 18 in the event of impact.

The gas welding apparatus 14 includes a welding tip 28 which is secured, by means of a coupling nut 30, to a forward end portion 32 of the torch handle 12. The forward end portion 32 is provided with a torch head 34 having external threading (not shown) on its outer surface 36, for receiving the coupling nut 30.

A cylindrical barrel 38, having an outer surface 40, is attached to the torch head 34, and extends rearwardly to a body "Y" 42. The leg 43 of the body "Y" is attached to the rear end 44 of the barrel 38. The two arms 45 of the body "Y" are each provided with a valve mechanism 46 that includes a control valve knob 47 and rear external threading 48 (see FIG. 6) to receive connecting apparatus (not shown) that leads to one of the combustion reagents (not shown). The combustion reagents (not shown) will usually include acetylene and oxygen. These valve mechanisms 46 are positioned at the rear end portion 49 of the torch handle 12. The torch handle 12 is also seen to have a longitudinal axis 50.

Figures 3, 4, 5:
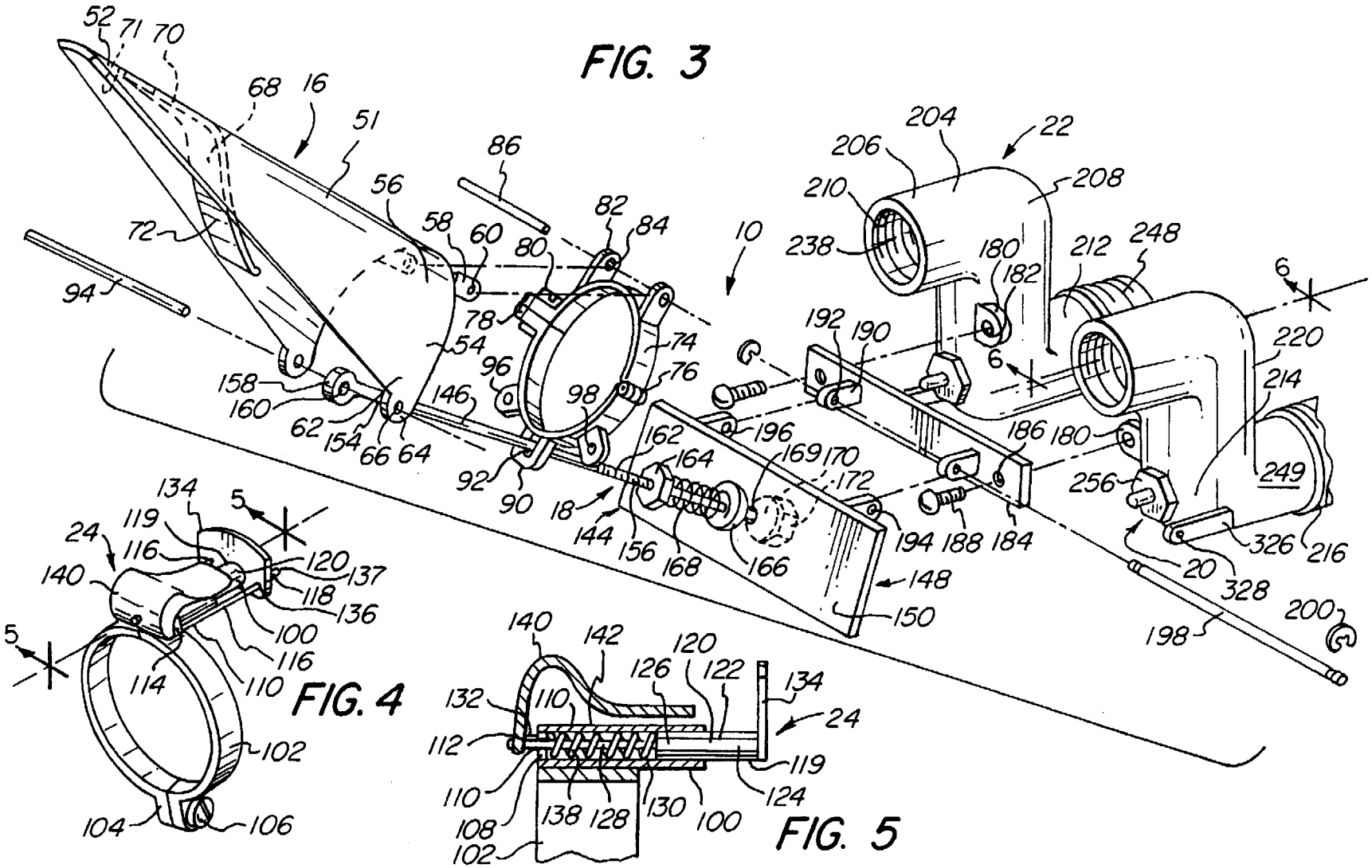
FIG. 3 is an exploded perspective view of the safety shut-off device of FIG. 1, omitting the lock-out member, and with one of the double elbow members shown in fragment.
FIG. 4 is a perspective view of the lock-out member of the safety shut-off device of FIG. 1.
FIG. 5 is a vertical cross-sectional view of the lock-out member of FIG. 4, taken along the line 5—5 thereof, looking in the direction of the arrows, and showing the clamp in fragment.

Referring to FIGS. 1–3, the trigger assembly 16, which serves as the trigger means and part of the actuating means, is seen as including a trigger member 51 which is shaped in the form of a hollow cylinder cut on an angle. The diameter of the cylinder is slightly larger than the diameter of the torch handle 12 to permit the trigger member 51 to closely overlay the torch handle 12. The trigger member 51 is parallel to the longitudinal axis 50 of the torch handle 12, enabling it to be grasped by the user of the gas welding apparatus 14 when the user grasps the torch handle 12. In this position, the trigger member 51 can be moved toward the torch handle 12. In addition, the trigger member 51 is configured and dimensioned to be long enough to be grasped by two hands at once. In this manner, the user can change hands without having to release his grasp on the trigger member 51.

The trigger member is shown as having a narrow free end 52 and a wide pivotable end 54. A top portion 56 of the wide pivotable end 54 is provided with a pair of parallel extending tabs 58, each with an aperture 60. A bottom portion 62 of the wide pivotable end 54 is also provided with a pair of parallel extending tabs 64, each with an aperture 66.

A flat spring 68, has a fixed end 70 welded, or otherwise attached, to the inside surface 71 of the trigger member 50. The flat spring 68 also has a free end 72 which bears against, and slides along, a portion of the outer surface 44) of the barrel 38 of the torch handle 12. The free end 72 can be coated with TEFLON®, or other suitable material, to facilitate sliding and avoid scoring of the outer surface 44).

A circular clamp 74 circumscribes and is releasably secured to the torch handle 12. The clamp 74 is secured in a conventional manner in that the clamp 74 has a hinge 76 and joinder tabs 78. A screw 80 is seated in apertures (not shown) in the tabs 78 to tighten the clamp 74 around the torch handle 12. The use of the clamp 74 is a factor in permitting the safety shut-off device 10 to be retro-fitted to the gas welding apparatus 14.

A pair of upstanding tabs 82 are positioned on the clamp 74, with each tab 82 having an aperture 84. The tabs 58 on the trigger member 51 and the tabs 82 on the clamp 74 are positioned with respect to each other so that the apertures 60 of the tabs 58 and the apertures 84 of the tabs 82 align. A hinge pin 86 is inserted in the apertures 60 and 84, and secured in position with circle clips (not shown), to permit the trigger member 51 to pivot on the clamp 74 in the direction of the arrow 88 of FIG. 1.

A depending tab 90 is positioned on the clamp 74 and is provided with an aperture 92. The tab 90 and aperture 92 serve as a guide for a linkage rod 146, which is described below. This linkage rod 146 is pivotably mounted on the trigger member 51 by way of a hinge pin 94 with circle clips (not shown) that passes through the apertures 66 on the tabs 64 of the trigger member 51.

The clamp 74 is further provided with a pair of depending tabs 96, which are each provided with a threaded aperture 98. These tabs 96 serve as a point of attachment of a shield 324, also to be described below.

Turning next to FIGS. 1, 4 and 5, the lock-out assembly 24 is seen as having a spring tube 100 mounted on a clamp 102 for support. The clamp has tabs 104 that abut one another and are each provided with an aperture (not shown) to receive a screw 106 for tightening the clamp 102 around the torch head 34 (see FIG. 1).

The spring tube 100 is provided with a wall 108 at the end 110 adjacent the forward end portion 32 of the torch handle 12. The wall 108 is provided with a central aperture 112 and with tube extension plates 114 extending laterally and at a right angle to the spring tube 100. Fastened to each of the tube extension plates 114 is a leg 116 of a U-shaped guide frame 118. The legs 116 extend in a direction parallel to the spring tube 100, from the tube extension plates 114 and beyond the end 119 of the spring tube 100 that is adjacent the rear end portion 49 of the torch handle 12.

A slide rod 120, which reciprocatably slides within the spring tube 100, has a large diameter portion 122, with an external end 124 and an internal end 126, and a small diameter portion 128 with an internal end 130 and an external end 132. The small diameter portion 128 is coaxial with the large diameter portion 122, with the internal end 130 of the small diameter portion 128 and the internal end 126 of the large diameter portion 122, being connected. The small diameter portion 128 is slidingly received by the aperture 112 in the wall 108.

A trigger block 134 is fastened to the external end 124 of the large diameter portion 122, and positioned transverse to the longitudinal axis of the large diameter portion 122. The trigger block 134 is provided with a pair of apertures 136, which each slidingly receive one of the legs 116 of the U-shaped guide frame 118. The legs 116 serve to maintain the proper orientation of the trigger block 134 by preventing it from pivoting about the longitudinal axis of the large diameter portion 122. In addition, the bight 137 of the U-shaped guide frame 118 limits the amount of travel of the trigger block 134.

A compression spring 138, positioned within the spring tube 100, bears against the wall 108 and the large diameter portion 122 to bias the slide rod 120 towards the end 119 adjacent the rear end portion 49 of the torch handle 12. This bias of the slide rod 120 serves to bias the trigger block 134 toward a position which is interposed between the trigger member 51 and the torch handle 12, thereby limiting the pivoting of the trigger member 51 about the clamp 74 and preventing inadvertent actuation of the valving assembly 20.

A thumb release 140 is attached to the external end 132 of the small diameter portion 128 and overlies at least a portion of the outer surface 142 of the spring tube 100. The thumb release 140 allows the user to overcome the bias of the compression spring 138, thereby removing the trigger block 134 from its position between the trigger member 51 and the torch handle 12, i.e.—from the position shown in solid lines to the position shown in phantom line in FIG. 1.

Referring to FIGS. 1–3, it is shown that the linkage assembly 18 is comprised of a linkage rod sub-assembly, generally indicated by the reference numeral 144, whose primary element is the linkage rod 146, mentioned previously, and a pressure plate sub-assembly, generally indicated by the reference numeral 148, whose primary element is a pressure plate 150, which serves to translate the axial motion of the linkage rod 146 into actuation of the plunger valve assembly 20.

In the linkage rod sub-assembly 144, the linkage rod 146 has a trigger end portion 154, adjacent the trigger member 51, and a valve end portion 156, adjacent the plunger valve assembly 20. The trigger end portion 154 has a flattened portion 158 provided with an aperture 160. It is this aperture 160 that aligns with the apertures 66 on the tabs 64 of the trigger member 51, with the hinge pin 94 passing through the apertures 66 and 160, to pivotably mount the linkage rod 146 on the trigger member 51.

The valve end portion 156 of the linkage rod 146 is provided with external threading 162 to receive a lock nut 164. A round faced washer 166, typically made of stainless steel, freely slides over the valve end portion 156 and is separated from the lock nut 164 by a compression spring 168 bearing against both the lock nut 164 and the round faced washer 166.

The valve end portion 156 of the linkage rod 146 then passes through an aperture 169 in the pressure plate 150 and a second round heed washer 170 and second lock nut 172 are placed over the valve end portion 156 of the linkage rod 146 to prevent the linkage rod 146 from being separated from the pressure plate 150. This configuration of external threading 162, lock nuts 164 and 172, round faced washers 166 and 170, and compression spring 168 allow the user to control the distance that the trigger member 51 must be moved to bring about a particular amount of pivoting of the pressure plate 150, and therefore the amount of pressure applied by the pressure plate 150 to the plunger valve assembly 20.

As previously mentioned, a depending tab 90 is positioned on the clamp 74 and is provided with an aperture 92. The tab 90 and aperture 92 serve as a guide for the linkage rod 146.

Figures 6, 7, 8:
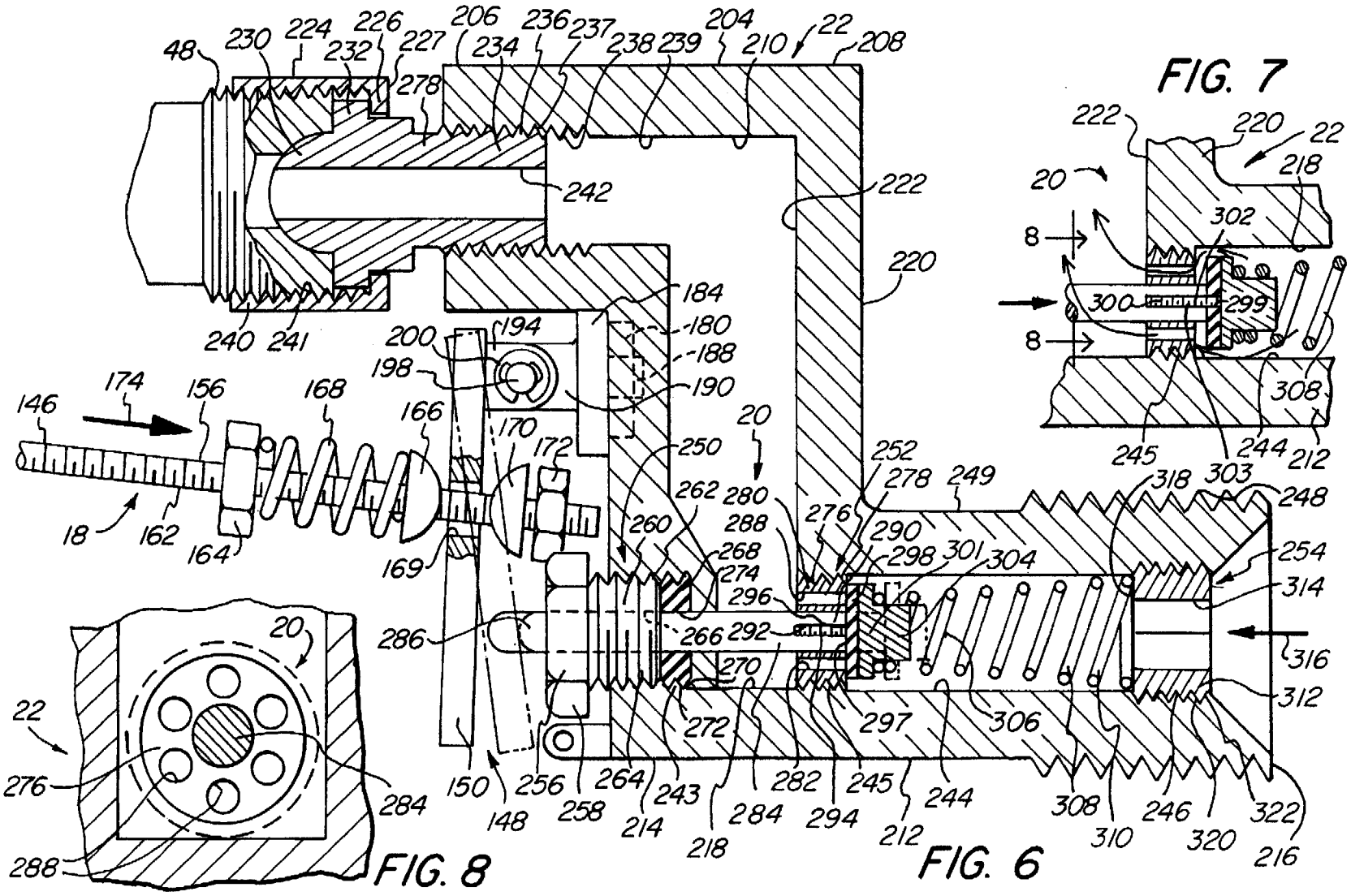
FIG. 6 is a vertical cross-sectional view, drawn to an enlarged scale, of one of the double elbow members of FIG. 3, taken along the line 6—6 thereof, looking in the direction of the arrows, and showing a fragmentary portion of the linkage assembly, and a portion of the pressure plate broken away to show detail.
FIG. 7 is a fragmentary view of FIG. 6, showing the valve seat sub-assembly in open position, and the surrounding portion of the double elbow, with the arrows showing the direction of flow of the gas.
FIG. 8 is a vertical cross sectional fragmentary view, in greatly enlarged scale, of the valve seat sub-assembly and surrounding portion of the double elbow of FIG. 7, taken along the line 8—8 thereof, and looking in the direction of the arrows.

As can be seen from both FIGS. 1 and 6, pressing the trigger member 51 towards the torch handle 12 causes the linkage rod 146 to move axially in the direction of the arrow 174 in FIG. 6.

The pressure plate sub-assembly 148 includes a pair of co-planar supporting bosses 180 positioned on the double-elbow housing 22. These supporting bosses 180 are provided with threaded apertures 182. A base plate 184, having non-threaded apertures 186, is mounted on the supporting bosses 180 with the apertures 186 and 182 aligned. The base plate 184 is secured to the supporting bosses 180 by means of machine screws 188.

The base plate 184 is further provided with a pair of upstanding ears 190, each having an unthreaded aperture 192. Also, the pressure plate 150 is provided with a pair of depending ears 194, each with an unthreaded aperture 196. Each of the depending ears 194 overlays one of the upstanding ears 190, with the apertures 196 and 192 aligned. A hinge pin 198 passes through the apertures 192 and 196 and is secured by circle clips 200. The pressure plate 150 is therefore rotatable about an axis 202, provided by the hinge pin 198, which is at a right angle to the longitudinal axis 50 of the torch handle 12.

Referring to FIG. 6, the double elbow housing 22 has an upper horizontal portion 204 with a forward end 206, adjacent the torch handle 12, and a rear end 208, distal from the torch handle 12. The upper horizontal portion 204 further includes a central bore 210, throughout its length. In a similar manner, the double elbow housing 22 has a lower horizontal portion 212 with a forward end 214, adjacent the torch handle 12, and a rear end 216, distal from the torch handle 12. The lower horizontal portion 212 also includes a central bore 218, throughout its length. A vertical portion 220 connects the rear end 208 of the upper horizontal portion 204 and the forward end 214 of the lower horizontal portion 212. This vertical portion 220 also has a central bore 222 throughout its length, and the bores 210, 218 and 222 are in communication with each other.

An attaching nut 224, with an inwardly directed circumferential flange 226 at its end 227 adjacent the upper horizontal portion 204, is positioned at the forward end 206 of the upper horizontal portion 204. An internal connector 228, has a head portion 230 with an outwardly directed circumferential flange 232 and a shaft portion 234 with external threading 236 on its outer surface 237.

The upper horizontal portion 204 is also provided with internal threading 238 on its inside surface 239, at the forward end 206.

The outwardly directed circumferential flange 232 on the internal connector 228, is positioned within the attaching nut 224 to overlay the inwardly directed circumferential flange 226, thereby interlocking the attaching nut 224 and the internal connector 228. The external threading 236 on the shaft 234 of the connector 228 cooperates with the internal threading 238 of the upper horizontal portion to secure the connector 228, and therefore the nut 224, to the double elbow housing 22. Internal threading 240 on the inside surface 241 of the attaching nut 224 cooperates with the external threading 48 on the valve mechanism 46 to releasably attach the forward end 206 of the upper horizontal portion 204 to the torch handle 12. It is important to note that a double elbow housing 22 is attached to each valve mechanism 46. Further, this releasable attachment of the forward end 206 to the torch handle 12 is a further factor in permitting the safety shut off device 10 to be retrofitted to the gas welding apparatus 14.

It should also be noted that the internal connector 228 has a central bore 242 running through both the head portion 230 and the shaft 234. This bore 242 is in communication with the bore 210 of the upper horizontal portion 204.

The forward end 214 of the lower horizontal portion 212 is provided with internal threading 243 on the inner surface 244 of the lower horizontal portion 212. Additional internal threading 245 is also provided on the inner surface 244 of the lower horizontal portion 212, intermediate its length. A third set of internal threading 246 is provided to the inner surface 244 of the lower horizontal portion 212 at its rear end 216. Also, external threading 248 is provided to the outer surface 249 of the rear end 216 of the lower horizontal portion 212. This external threading 248 is used to connect the double elbow housing 22 to the supply of pressurized combustion reagents (not shown).

A plunger valve assembly 20 is seated in the lower horizontal portion 212 of each double elbow housing 22, and provides the valving means. The plunger valve assembly 20 is therefore operatively positioned between the supply of pressurized combustion reagents and the torch handle 12. The plunger valve assembly 20 is generally comprised of the gland sub-assembly, generally indicated by the reference numeral 250, the valve seat sub-assembly, generally indicated by the reference numeral 252, and the spring seat sub-assembly, generally indicated by the reference numeral 254.

The gland sub-assembly 250 is comprised of a gland nut 256 having a head 258 and a shaft 260 with external threading 262 on its outer surface 264. The external threading 262 cooperates with the internal threading 243 at the forward end 214 of the lower horizontal portion 212 to seat the gland nut 256 in the lower horizontal portion 212. This gland nut 256 is provided with a central bore 266.

Adjacent the gland nut 256, and remote from the forward end 214 of the lower horizontal portion 212 is packing material 268, typically formed of a graphite composite. As this packing material 268 is forced into the bore 218 of the lower horizontal portion 212, the outer surface 270 of the packing material 268 is conformed by the internal threading 243 to form external threading 272. The packing material 268 is also provided with a central bore 274.

Referring to FIGS. 6–8, the valve seat sub-assembly 252 includes a cylindrical valve seat member 276 that is provided with external threading 278 on its outer surface 280 for cooperation with the internal threading 245 that is intermediate the length of the lower horizontal portion 212 of the double elbow housing 22. The valve seat member 276 is also provided with a central longitudinal bore 282 through which a cylindrical plunger member 284 slidingly reciprocates. It should be noted that the plunger member 284 is further provided with a forward portion 286, adjacent the forward end 214 of the lower horizontal portion 212 of the double elbow housing 22. This forward portion 286 slidingly reciprocates through the central bore 274 of the packing material 268 and the central bore 266 of the gland nut 256, and extends through the gland nut 256 to slightly protrude from the head 258 and be engaged by the pressure plate 150. In this manner, the gland sub-assembly 250 supports and guides the plunger member 284 in a gas-tight way.

The valve seat member 276 is further provided with a series of longitudinal bores 288, parallel to each other and to the central longitudinal bore 282, to allow for the passage of a combustion reagent through the bore 218 of the lower horizontal portion 212. (See specifically FIG. 6).

The plunger member 284 further includes a rear portion 290 having a rear bore 292 with internal threading 294 on its inner surface 296. Overlaying the end surface 297 of the rear portion 290 of the plunger member 284 is a high temperature washer 298, generally formed of TEFLON®, whose plane is transverse to the longitudinal axis of the plunger member 284. The high temperature washer 298 is dimensioned and configured to overlay the bores 288 in the valve seat member 276, when the plunger member 284 is moved laterally towards the forward end 214 of the lower horizontal portion 212, thereby preventing the flow of the combustion reagent through the bore 218 of the lower horizontal portion 212. (See FIG. 6).

The high temperature washer 298 is further provided with an aperture 299 to receive a shaft 300 that is integral with a metal backing washer 301. The shaft 300 is provided with external threading 302 on its outer surface 303 to cooperate with the internal threading 294 and secure both the high temperature washer 298 and the metal backing washer 301 to the plunger member 284.

A protuberance 304 extends rearwardly from the metal backing washer 301 and is integral therewith. This protuberance 304 serves to seat the narrow end 306 of a conically shaped compression spring 308, which bears against the metal hacking washer 301, thereby biasing the plunger member 284 toward the forward end 214 of the lower horizontal portion 212. The conical shaped compression spring 308 further has a wide end 310.

Referring to FIG. 6, the spring seat sub-assembly 254 includes a spring mount bushing 312 with a central longitudinal bore 314, permitting the combustion reagent (not shown) to flow in the direction of the arrow 316 in FIG. 6. The spring mount bushing 312 provides a shoulder 318 to receive the wide end 310 of the compression spring 308 which bears against the spring mount bushing 312. The spring mount bushing 312 has external threading 320 on its outer surface 322 for cooperation with the internal threading 246 at the rear end 216 of the lower horizontal portion 212.

It can be seen that the compression spring 308 biases the plunger member 284 towards the forward end 214 of the lower horizontal portion, thereby overlaying the longitudinal bores 288 in the valve seat member 276 with the high temperature washer 298, and stopping the flow of the combustion reagent (not shown) through the bore 218 of the lower horizontal portion 212.

Referring again to FIG. 1, the shield plate assembly 26 is shown in phantom line, and has as its primary function, the protection of the linkage assembly 18, as well as of other parts, in the event of impact. The shield plate assembly 26 includes primarily the shield 324. The shield 324 is generally trough shaped and is specifically dimensioned and configured to cover the parts to be protected.

The shield plate assembly 26 further includes a pair of shield attachment bosses 326, with threaded apertures 328, positioned on the double elbow housing 22, to secure the shield 324. The other points of attachment of the shield 324 include the tabs 96 on the clamp 74.

The compression springs 138, 168 and 308 are generally fabricated of steel. With this exception, and with the exception of the few components previously otherwise designated, all of the components of the safety shut-off device 10 are fabricated from brass. An acceptable alternative is stainless steel.

The invention having been thus described, the operation will now be clear to those of ordinary skill in the art as described below. When a user is desirous of lighting the gas welding apparatus 14, the user would employ the thumb release 140 of the lock-out assembly 24 to move the trigger block 134 from between the trigger member 51 and the torch handle 12.

The user then grasps both the trigger member 51 and the torch handle 12 and moves the trigger member 51 toward the torch handle 12 and against the bias of the flat spring 68. This causes the trigger member 51 to pivot about the hinge pin 86 on the clamp 74. In pivoting, the bottom portion 62 of the wide pivotable end 54 moves the linkage red 146 axially through the guide tab 90 on the clamp 74 and toward the pressure plate 150.

As the linkage rod 146 continues to move axially, the round faced washer 166 engages the pressure plate 150 with increasing force as the compression spring 168 between the round faced washer 166 and the lock nut 164 begins to compress. This force causes the pressure plate 150 to rotate about the hinge pin 198 until it engages the plunger member 284 of each valve assembly 20.

The pivoting of the pressure plate 150 causes the plunger members 284 to move axially in a line of travel that is parallel to the longitudinal axis 50 of the torch handle 12, and toward the rear end 216 of the lower horizontal portion 212. This motion serves to overcome the bias of the compression spring 308 and space the high temperature washer 298 from the valve seat member 276 so that the washer 298 no longer overlays the bores 288. (See specifically FIG. 7).

The combustion reagent may now flow from the source of pressurized combustion reagent through the bore 314 in the spring mount bushing 312, the bore 218 of the lower horizontal portion 212, the bores 288 in the valve seat member 276, the bore 222 of the vertical portion 220, the bore 210 of the upper horizontal portion 204, the bore 242 of the internal connector 228, the attaching nut 224, and into the torch handle 12.

The user then proceeds in the usual manner to adjust his gas ratio and light the gas welding apparatus 14.

It is possible for a user to intentionally release his grip on the trigger member 51, such as by setting the torch handle 12 down. In the alternative, the user may unintentionally release his grip by either accidentally dropping the torch handle 12 or by being unable to maintain his grip due to fainting or other condition.

In all of these instances of the user's grip being released, the flat spring 68 would act to push the trigger member 51 away from the torch handle 12. This pivoting motion of the trigger member 51 would serve to move the linkage rod 146 axially away from the pressure plate 150.

As the linkage rod 146 continues to move axially away from the pressure plate 150, the round faced washer 166 would disengage from the pressure plate 150 as the compression spring 168 between the round faced washer 166 and the lock nut 164 begins to again expand and withdraw from the round faced washer 166. This motion would again allow the pressure plate 150 to rotate about the hinge pin 198 under the force imparted by both the second round faced washer 170 and the plunger members 284.

The pivoting of the pressure plate 150 allows the plunger members 284 to move axially toward the forward end 214 of the lower horizontal portion 212 under the action of the compression springs 308. The normal flow of the combustion reagent through the lower horizontal portion 212 also tends to cause additional pressure on the high temperature washer 298 and the metal backing washer 301, biasing the washers 298 and 301, and therefore the plunger member 284 toward the forward end 214. This motion serves to cause the high temperature washer 298 to abut valve seat member 276 and overlay the bores 288, thereby stopping the flow of combustion reagents (not shown) to the torch handle 12 and extinguishing any flame. This change in the position of the valve assembly 20 occurs substantially instantaneously.

Figure 9:
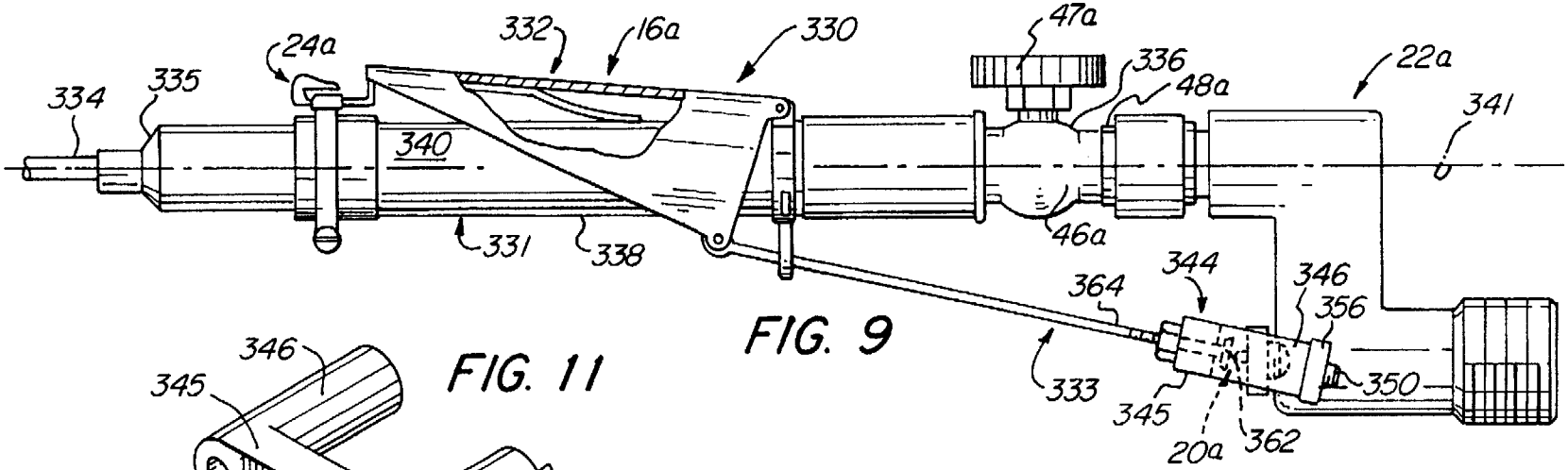
FIG. 9 is a side elevational view of a second embodiment of a safety shut-off device, embodying the principals of the present invention, and shown mounted on a torch handle of a pony torch, and with part of the trigger member broken away to show detail.
Figure 11:
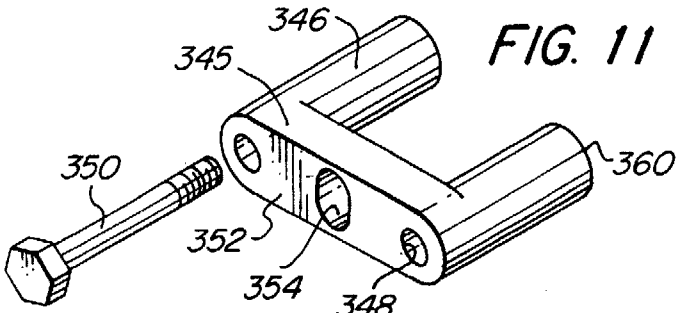
FIG. 11 is a perspective view of the linkage guide and a machine screw of the safety shut-off device of FIG. 9, drawn to an enlarged scale.
Figure 10:
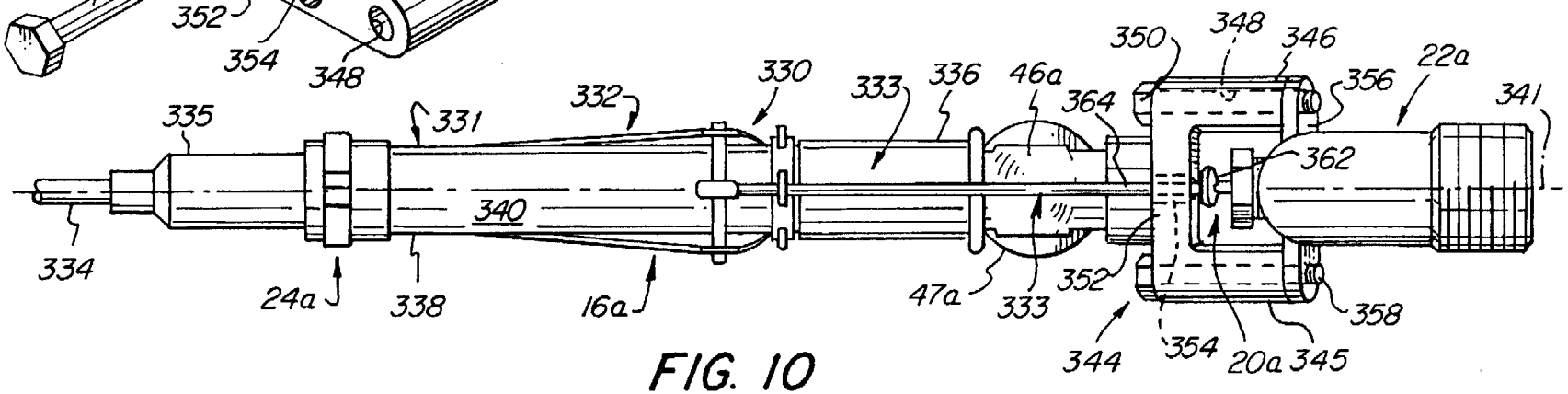
FIG. 10 is a bottom plan view of the safety shut-off device of FIG. 9.

Referring to FIGS. 9–11, there is shown an alternate embodiment of the safety shut-off device, embodying the principles of the present invention, and generally indicated by the reference numeral 330.

In this embodiment, elements having reference numerals with a suffix are identical to elements with the same numeral, but no suffix, in the previous embodiment. This embodiment is identical to the previous embodiment in all respects, except as otherwise noted below.

The safety shut-off device 330 is shown mounted on a torch handle, generally indicated by the reference numeral 331, of a pony torch, generally indicated by the reference numeral 332.

As in the previous embodiment, the safety shut-off device 330 includes a trigger assembly, generally indicated by the reference numeral **16*a*, mounted on the torch handle 331. A linkage assembly, generally indicated by the reference numeral 333, serves to operatively connect the trigger assembly 16*a* with a plunger valve assembly, generally indicated by the reference numeral am, which is seated in a double elbow housing, generally indicated by the reference numeral 22*a***.

A lock-out assembly, generally indicated by the reference numeral **24*a*, serves to prevent inadvertent actuation of the plunger valve assembly 20*a***.

The pony torch 332 includes a welding tip 334 which is secured to a forward end portion 335 of the torch handle 331. The torch handle 331 also has a rear end portion 336.

A cylindrical barrel 338, having an outer surface 340, is attached to the welding tip 334, and extends rearwardly to a valve mechanism **46*a* that includes a control valve knob 47*a* and rear external threading 48*a* to receive connecting apparatus (not shown) that leads to a combustion reagent (not shown), that is typically acetylene. In the case of the pony torch 332, unlike the gas welding apparatus 14 of the first embodiment, only the fuel is provided under pressure. There is no provision for oxygen being provided under pressure, since the pony torch 332** utilizes air.

The valve mechanism **46*a* is positioned at the rear end portion 336 of the torch handle 331. The torch handle 331 is also seen to have a longitudinal axis 341**.

The linkage assembly 332 is identical to the linkage assembly 18 of the previous embodiment in all respects, except as noted below. The linkage red sub-assembly 342 of this embodiment has a linkage red 343 which does not include the external threading 162 from the previous embodiment. The linkage rod sub-assembly 342 also does not include the following elements from the previous embodiment: lock nuts 164 and 172, round faced washers 166 and 170, and the compression spring 168, as there is no pressure plate 150, with aperture 169, to be engaged.

Moreover, the linkage assembly 333 does not have a pressure plate sub-assembly 148 as described for the previous embodiment. In its place, the linkage assembly 333 of this embodiment has a linkage guide sub-assembly, generally indicated by the reference numeral 344.

The linkage guide sub-assembly 344 has a U-shaped linkage guide 345 with leg portions 346. Each leg portion 346 has a longitudinal bore 348 dimensioned and configured to receive a machine screw 350. In addition, the bight portion 352 of the linkage guide 345 has a bore 354 configured and dimensioned to receive the linkage rod 343 to direct it toward the plunger valve assembly **20*a***.

The double elbow housing **22*a* is provided with a pair of bosses 356, each having a threaded aperture 358 to receive a machine screw 350 and seat the end 360 of one of the leg portions 346 on the bosses 356**.

A small plate 362 is fastened to the valve end portion 364 of the linkage red 343.

The elements of this embodiment are fabricated of the same materials as the previous embodiment. Specifically, the linkage guide subassembly 344 is fabricated preferably from brass, but stainless steel may be used with equal success.

The alternate embodiment is used in a manner identical to that of the previous embodiment with the following exception. Axial movement of the linkage red 343 toward the plunger valve assembly **20*a* causes the plate 362 to bear directly against the plunger member 284*a*** to effect its axial movement.

Thus, it can be seen from the foregoing detailed specification and attached drawings that the safety shut-off device of the present invention provides a true dead-man switch, whereby the positive action of grasping a trigger member is required for the apparatus to operate. Additionally, the device can be retro-fitted to existing gas welding apparatus.

An advantageous feature of the safety shut-off device is that the trigger actuating the apparatus is dimensioned and configured to be grasped by two hands at once, allowing the user to change hands without releasing the trigger of the safety shut-off device. Further, the user will not have to readjust the mixture of gasses in the gas welding apparatus to re-light the apparatus after the safety shut-off device extinguishes the flame of the apparatus. The safety shut-off device is also simple in construction, inexpensive to manufacture, and capable of a long life of useful service with a minimum of maintenance.

It is obvious that minor changes may be made in the form and construction of the invention without departing from the material spirit thereof. It is not, therefore, desired to confine the invention to the exact form herein shown and described, but it is desired to include all such as properly come within the scope claimed.

The invention having been thus described, what is claimed as new and desired to secure by Letters Patent is:

1. A safety shut-off device adapted for use with a gas welding apparatus, the apparatus having a torch handle and a supply of a pressurized combustion reagent, said safety shut-off device comprising:

(a) at least one plunger valve having a valve seat and a reciprocatable plunger member passing through said valve seat for movement along a line of travel which is parallel to the longitudinal axis of the handle, said plunger valve adapted to be positioned between the handle and the supply of pressurized combustion reagent, said plunger member having an end adapted to be adjacent the handle, and said plunger valve being actuatable between a first state, for operatively connecting the handle to the supply of pressurized combustion reagent, and a second state, for operatively disconnecting the handle from the supply of pressurized combustion reagent, said plunger valve being biased towards said second state and actuatable from said first state to said second state substantially instantaneously;

(b) a clamp adapted to circumscribe and to be releasably secured to the handle;

(c) an elongated trigger member having a pivotable end and a free end, said pivotable end being pivotably mounted on said clamp so that said trigger member overlays at least a portion of the handle and lies parallel to the longitudinal axis of the handle to allow said trigger member to be grasped by the user of the gas welding apparatus when the user grasps the handle, and to allow the trigger member to be moved toward said handle;

(d) a linkage rod having a trigger end portion and a valve end portion, said linkage rod being pivotably attached at its trigger end portion to said trigger member;

(e) a pressure plate operatively connected to the valve end portion of said linkage rod, and rotatable about an axis which is at a right angle to the longitudinal axis of the handle, said pressure plate overlying said end of said plunger member, wherein movement of said linkage rod, toward said valve, causes pivoting of said pressure plate so that the pressure plate engages the end of said plunger member, and moves said plunger member along said line of travel, said trigger member, said linkage rod and said pressure plate actuating said plunger valve from said second state to said first state only when the handle and said trigger member are grasped by the user and said trigger member pivoted about said clamp towards the handle; and (f) a lock-out member adapted to be reciprocatably interposed between said trigger member and the handle to limit the pivoting of said trigger member about said clamp and prevent inadvertent actuation of said valving means.

2. The safety shut-off device as recited in claim 1, further comprising a double elbow member comprising:

(a) an upper horizontal portion with a forward end adapted to be adjacent the handle and a rear end adapted to be distal from the handle, said forward end of said upper horizontal portion adapted to be releasably attachable to the handle;

(b) a lower horizontal portion with a forward end adapted to be adjacent the handle and a rear end adapted to be distal from the handle; and (c) a vertical portion connecting the rear end of said upper horizontal portion and the forward end of said lower horizontal portion, and wherein said plunger valve is seated in the lower horizontal portion of said double elbow member.

* * * * *